US011520277B1

(12) United States Patent
Kano

(10) Patent No.: US 11,520,277 B1
(45) Date of Patent: Dec. 6, 2022

(54) CLEANING BODY, CLEANING DEVICE, CHARGING DEVICE, ASSEMBLY, AND IMAGE FORMING APPARATUS

(71) Applicant: FUJIFILM Business Innovation Corp., Tokyo (JP)

(72) Inventor: Fuyuki Kano, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/749,124

(22) Filed: May 19, 2022

(30) Foreign Application Priority Data

Dec. 28, 2021 (JP) ..... JP2021-215066

(51) Int. Cl.
*G03G 15/02* (2006.01)
*G03G 21/00* (2006.01)

(52) U.S. Cl.
CPC ..... *G03G 21/0041* (2013.01); *G03G 15/0225* (2013.01); *G03G 2221/001* (2013.01)

(58) Field of Classification Search
CPC ..... G03G 15/0216; G03G 15/0225
USPC ..... 399/100, 176
See application file for complete search history.

(56) References Cited

U.S. PATENT DOCUMENTS

| | | | | |
|---|---|---|---|---|
| 8,538,287 | B2 | 9/2013 | Kawai | |
| 9,372,427 | B1 * | 6/2016 | Kano et al. | G03G 15/0225 |
| 10,423,118 | B1 * | 9/2019 | Mizoguchi et al. | G03G 15/0225 |
| 10,761,449 | B1 * | 9/2020 | Narita et al. | G03G 15/0225 |
| 10,990,058 | B1 | 4/2021 | Kano et al. | |

FOREIGN PATENT DOCUMENTS

| | | |
|---|---|---|
| JP | H02272594 | 11/1990 |
| JP | 2012014011 | 1/2012 |
| JP | 2021157041 | 10/2021 |

* cited by examiner

*Primary Examiner* — William J Royer
(74) *Attorney, Agent, or Firm* — JCIPRNET

(57) ABSTRACT

A cleaning body includes a core, a foam elastic layer that is disposed to be wound around an outer peripheral surface of the core in a helical shape from one end to the other end of the core, and an adhesive layer that adheres the core and the foam elastic layer, in which a diameter of a tip portion of a cell skeleton protruding on a surface of the foam elastic layer is equal to or less than 50 μm, and in a case where an inner peripheral length of the foam elastic layer in a cross section of the core in a radial direction is X (mm) and a thickness of the foam elastic layer is Y (mm), a value of $X \times Y^2$ is equal to or greater than 45.

15 Claims, 8 Drawing Sheets

CLEANING BODY, CLEANING DEVICE, CHARGING DEVICE, ASSEMBLY, AND IMAGE FORMING APPARATUS

CROSS-REFERENCE TO RELATED APPLICATIONS

This application is based on and claims priority under 35 USC 119 from Japanese Patent Application No. 2021-215066 filed Dec. 28, 2021.

BACKGROUND

(i) Technical Field

The present disclosure relates to a cleaning body, a cleaning device, a charging device, an assembly, and an image forming apparatus.

(ii) Related Art

JP2012-014011A discloses a cleaning member having a core, and an elastic layer that is disposed by winding a striped elastic member around an outer peripheral surface of the core in a helical shape. In a case where a thickness of the elastic layer in a helical width direction central portion in a state of being wound around the outer peripheral surface of the core is t (mm), and a thickness of the striped elastic member in a width direction central portion before being wound around the outer peripheral surface of the core T (mm), a relationship of $0.7<t/T<1.0$ is satisfied.

JP2021-157041A discloses a cleaning body having a core, and a foam elastic layer that is disposed to be wound around an outer peripheral surface of a core in a helical shape from one end to the other end of the core. An equivalent circle diameter of a tip portion of a cell skeleton protruding on a surface of the foam elastic layer is equal to or less than 50 μm, a helical pitch of the foam elastic layer is equal to or less than 5 mm, and a helical angle of the foam elastic layer is equal to or less than 15°.

SUMMARY

Aspects of non-limiting embodiments of the present disclosure relate to a cleaning body that restrains a foam elastic layer from being peeled and achieves excellent cleaning performance on a body to be cleaned, compared to a cleaning body in which a diameter of a tip portion of a cell skeleton protruding on a surface of a foam elastic layer is greater than 50 μm or a cleaning body in which an inner peripheral length X of a foam elastic layer in a cross section of a core in a radial direction and a thickness Y of the foam elastic layer has a relationship of $X \times Y^2 < 45$.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

Specific means for solving the above-described problem includes the following aspect.

According to an aspect of the present disclosure, there is provided a cleaning body including a core, a foam elastic layer that is disposed to be wound around an outer peripheral surface of the core in a helical shape from one end to the other end of the core, an adhesive layer that adheres the core and the foam elastic layer, in which a diameter of a tip portion of a cell skeleton protruding on a surface of the foam elastic layer is equal to or less than 50 μm, and in a case where an inner peripheral length of the foam elastic layer in a cross section of the core in a radial direction is X (mm), and a thickness of the foam elastic layer is Y (mm), a value of $X \times Y^2$ is equal to or greater than 45.

BRIEF DESCRIPTION OF THE DRAWINGS

Exemplary embodiment(s) of the present invention will be described in detail based on the following figures, wherein.

DETAILED DESCRIPTION

Figure 1:
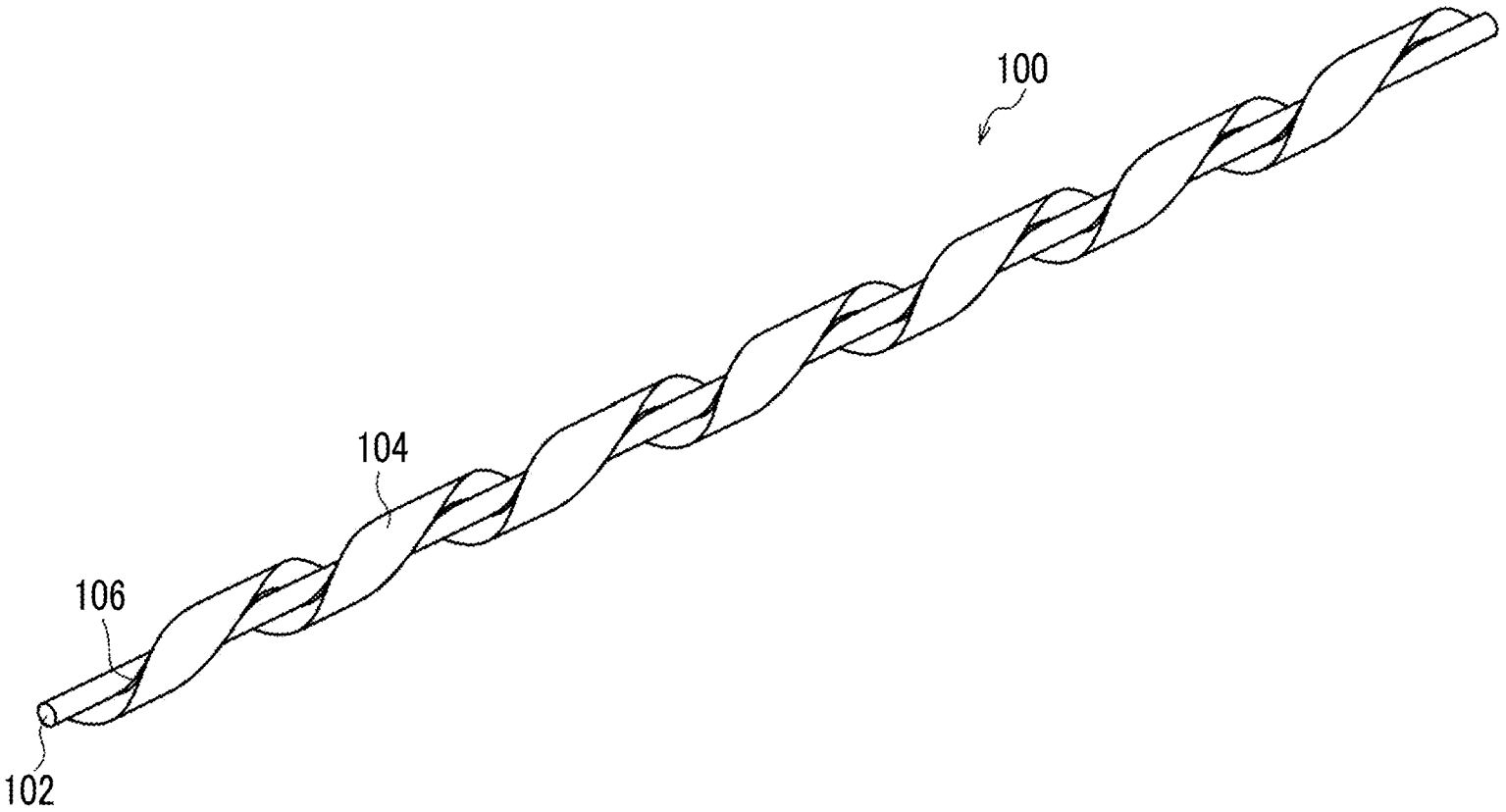
FIG. 1 is a schematic perspective view showing an example of a cleaning body according to the present exemplary embodiment.

Hereinafter, an exemplary embodiment of the present disclosure will be described. Descriptions and examples illustrate the exemplary embodiment and do not limit the scope of the exemplary embodiment.

Numerical value ranges using "to" in the present disclosure indicate ranges including numerical values described before and after "to" as a minimum value and a maximum value, respectively.

In numerical ranges described stepwise in the present disclosure, an upper limit value or a lower limit value described in one numerical range may be replaced with an upper limit value or a lower limit value in another numerical range described stepwise. In the numerical ranges described in the present disclosure, upper limit values or lower limit values in the numerical value range may be replaced with values indicated in the examples.

The term "step" in the present disclosure is not limited to an independent step, and even steps that cannot be clearly distinguished from other steps are included in this term as long as the intended purposes of the steps are attained.

In a case where the exemplary embodiment in the present disclosure is described referring to the drawings, the configuration of the exemplary embodiment is not limited to the configuration shown in the drawings. The size of a member in each drawing is conceptual, and a relative size relationship between the members is not limited thereto. The members having the same functions and operations are represented by the same reference numerals throughout the drawings, and descriptions thereof will not be repeated.

Each component in the present disclosure may contain a plurality of corresponding substances. In regard to the amount of each component in a composition in the present disclosure, in a case where there are a plurality of substances corresponding to each component in the composition, the amount of each component means a total amount of a plurality of substances in the composition unless otherwise specified.

Particles corresponding to each component in the present disclosure may contain a plurality of particles. In a case where there are a plurality of particles corresponding to each component in the composition, a particle size of each component means a value of a mixture of a plurality of particles in the composition unless otherwise specified.

Cleaning Body

A structure of a cleaning body according to the present exemplary embodiment will be described referring to the drawings.

FIG. 1 is a schematic perspective view showing an example of the cleaning body according to the present exemplary embodiment.

Figure 2:
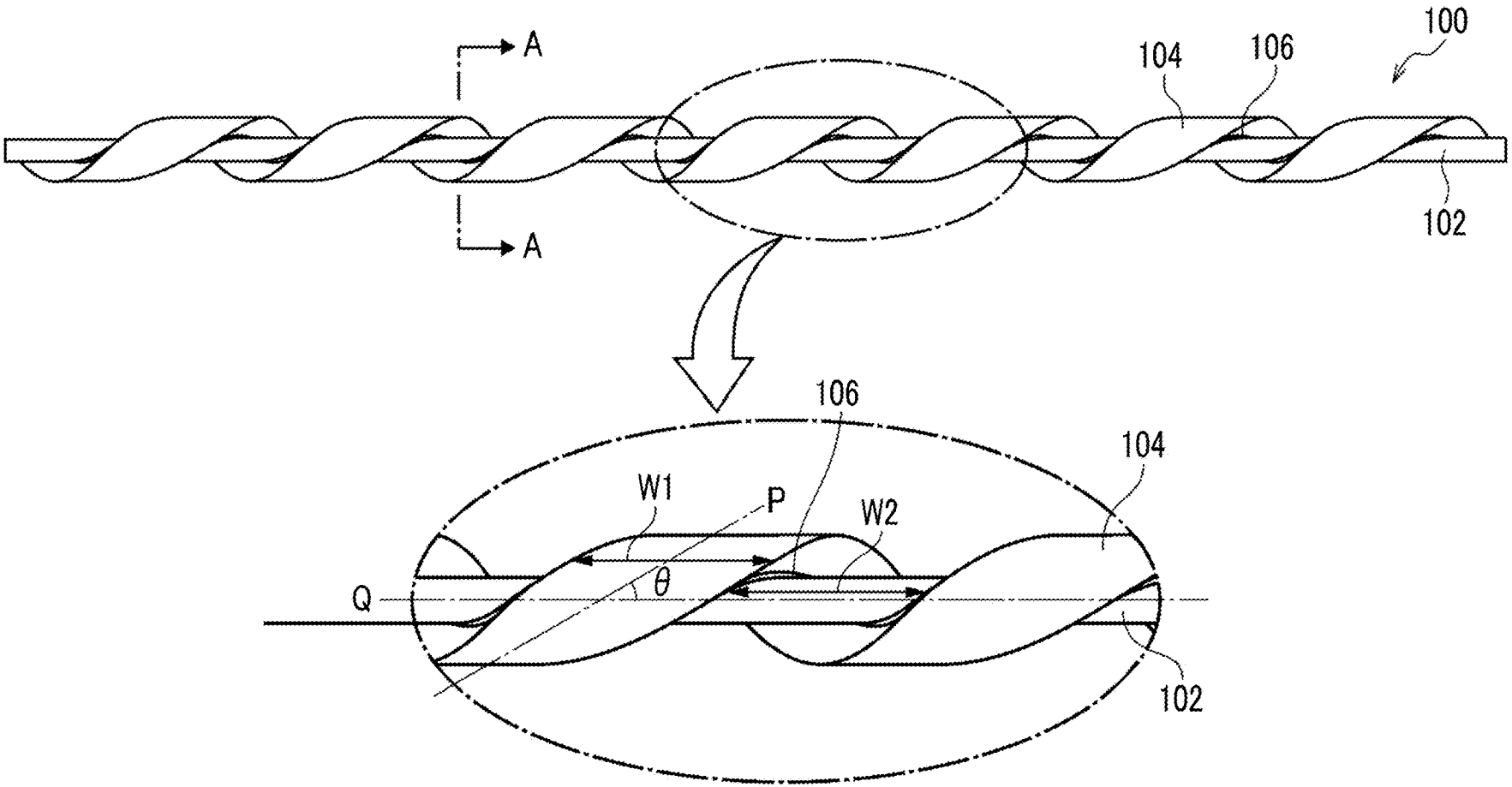
FIG. 2 is a schematic plan view showing an example of the cleaning body according to the present exemplary embodiment.

FIG. 2 is a schematic plan view showing an example of the cleaning body according to the present exemplary embodiment. FIG. 2 is a plan view of FIG. 1.

A cleaning body 100 shown in FIGS. 1 and 2 is a member including a core 102, a foam elastic layer 104, and an adhesive layer 106. The core 102 and the foam elastic layer 104 are adhered by the adhesive layer 106.

The core 102 is a rod-shaped or columnar member. A diameter of the core 102 is preferably, for example, equal to or greater than 2 mm and equal to or less than 12 mm, more preferably equal to or greater than 3 mm and equal to or less than 10 mm, and still more preferably equal to or greater than 4 mm and equal to or less than 8 mm.

The foam elastic layer 104 is a layer formed by winding a band-shaped foam elastic member in a helical shape, and is a layer disposed on an outer peripheral surface of the core 102 in a helical shape at intervals from one end to the other end of the core 102.

The cleaning body 100 may have a region where cleaning performance on a body to be cleaned may not be exhibited, in an end portion in an axial direction. In this case, in the cleaning body 100, the foam elastic layer 104 may not be disposed in the end portion corresponding to the above-described region.

The foam elastic layer 104 wound around the core 102 in a helical shape may be wound clockwise or counterclockwise.

The cleaning body 100 may include a plurality of stripes (for example, two stripes) of foam elastic layers 104. A plurality of stripes (for example, two stripes) of foam elastic layers 104 are independent layers formed by winding a plurality (for example, two) of band-shaped foam elastic members around the outer peripheral surface of the core 102 in a helical shape. A plurality of stripes of foam elastic layers 104 may be disposed away from each other or may be disposed in such a manner that sides in a longitudinal direction are in contact with each other. A plurality of stripes of independent foam elastic layers 104 are provided, whereby the cleaning performance of the cleaning body 100 is improved.

The adhesive layer 106 has a width and a length substantially identical to the foam elastic layer 104, for example. In a case where the cleaning body 100 has a plurality of stripes of foam elastic layers 104, the adhesive layer 106 may be a layer of a plurality of stripes independent for each of a plurality of stripes of foam elastic layers 104 or may be a layer of one stripe where a plurality of stripes of foam elastic layers 104 are placed.

In the cleaning body 100, in a case where an inner peripheral length of the foam elastic layer 104 in a cross section of the core 102 in a radial direction is X (mm), and a thickness of the foam elastic layer 104 is Y (mm), a value of $X \times Y^2$ is equal to or greater than 45.

The foam elastic layer 104 is disposed to be wound around the core 102 in a helical shape and is fixed to the core 102 in a state in which deformation occurs. In the foam elastic layer 104 fixed in a state in which deformation occurs, the greater the value of X and the greater the value of Y, the greater the force that the foam elastic layer 104 tends to be restored to an original shape, that is, the force that the foam elastic layer 104 is peeled from the adhesive layer 106. On the other hand, as the value of $X \times Y^2$ is greater, a cleaning effect by compression and deformation of the foam elastic layer 104 increases.

The inner peripheral length X (mm) of the foam elastic layer 104 in the cross section of the core 102 in the radial direction is an average of dimension in a cross section of the cleaning body 100 taken in parallel with the radial direction of the core 102, and is an average of the inner peripheral length of the foam elastic layer 104 in a cross section of the foam elastic layer 104. In a state in which a peripheral direction of the cleaning body 100 is fixed, the inner peripheral length of the foam elastic layer 104 in the above-described cross section for each helix is measured (for example, in a case where the number of helical turns is seven, the inner peripheral length is measured at seven places), and a value of an arithmetical mean is the inner peripheral length X(mm). Measurement may be performed by a destructive method that produces the cross section of the foam elastic layer 104 or a method that does not destruct the foam elastic layer 104 that for example, a method using laser scan dimension measuring instrument. In a case where the cleaning body 100 has a plurality of stripes of foam elastic layers 104, the inner peripheral length X is obtained for each stripe.

Figure 3:
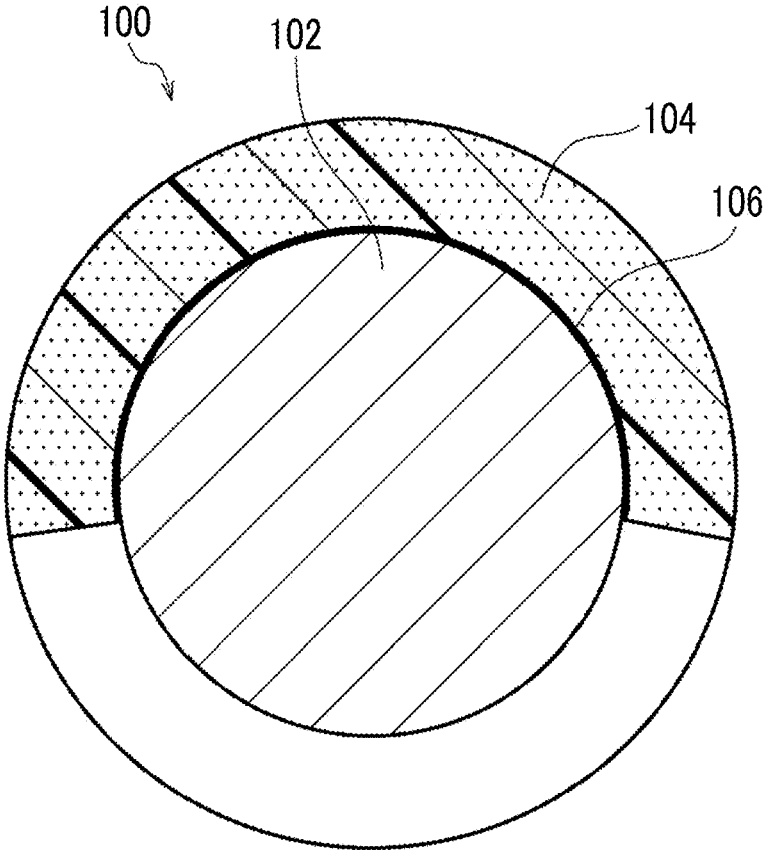
FIG. 3 is a schematic cross-sectional view of an example of the cleaning body according to the present exemplary embodiment taken in parallel with a radial direction of a core.

FIG. 3 is a cross-sectional view of the cleaning body 100 taken in parallel with the radial direction of the core 102 (that is, a cross-sectional view taken along an A-A direction of FIG. 2). The average of the inner peripheral length of the foam elastic layer 104 in the cross section of the foam elastic layer 104 is the inner peripheral length X (mm). In the cleaning body 100 shown in FIG. 3, since a width of the foam elastic layer 104 and a width of the adhesive layer 106 are identical, in the cross section shown in FIG. 3, a length of an inner periphery of the foam elastic layer 104 is, i.e., a length of a boundary of the foam elastic layer 104 and the adhesive layer 106.

The thickness Y (mm) of the foam elastic layer 104 is a value that is measured by the following measurement method.

Scanning is performed in an axial direction of the cleaning body 100 using laser scan dimension measuring instrument (for example, Mitsutoyo Corporation, LASER SCAN MICROMETER) at a traverse speed of 1 mm/s in a state in which the peripheral direction of the cleaning body 100 is fixed, and a profile of the thickness of the foam elastic layer 104 is obtained. The same scanning is performed three times while shifting the peripheral direction at an interval of 120°. The thickness Y (mm) of the foam elastic layer 104 is calculated from three profiles. In a case where the cleaning body 100 has a plurality of stripes of foam elastic layers 104, the thickness Y is obtained for each stripe.

Next, a surface property of the foam elastic layer 104 will be described referring to FIGS. 4A and 4B.

Figure 4A:
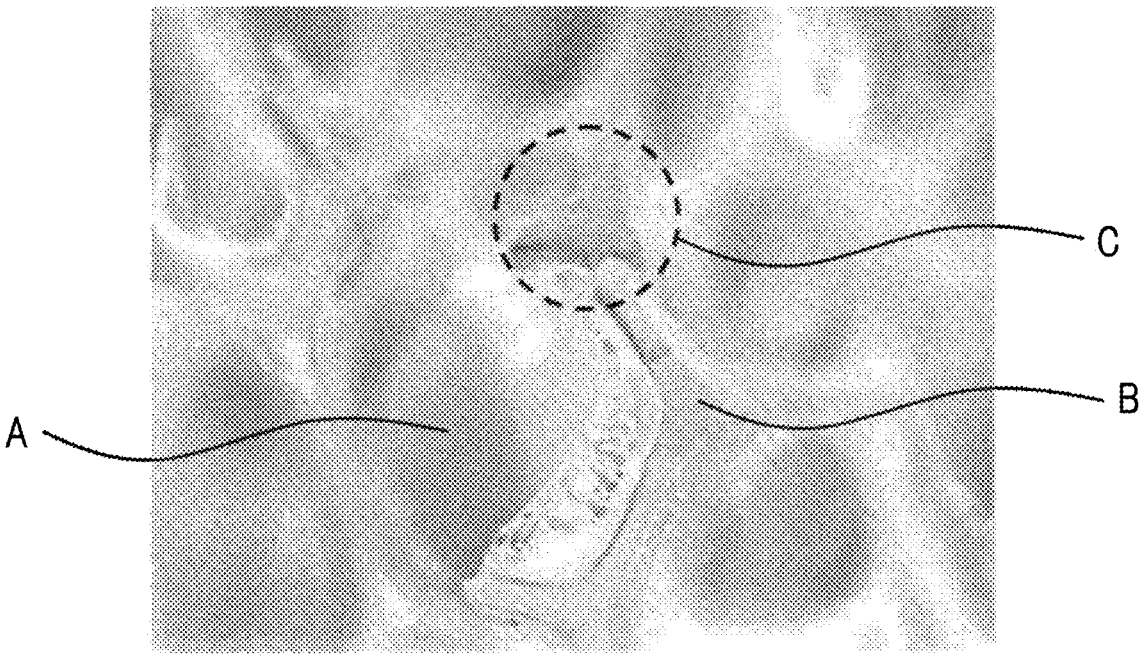
FIG. 4A is an image of an example of a foam elastic layer captured by a confocal microscope.
Figure 4B:
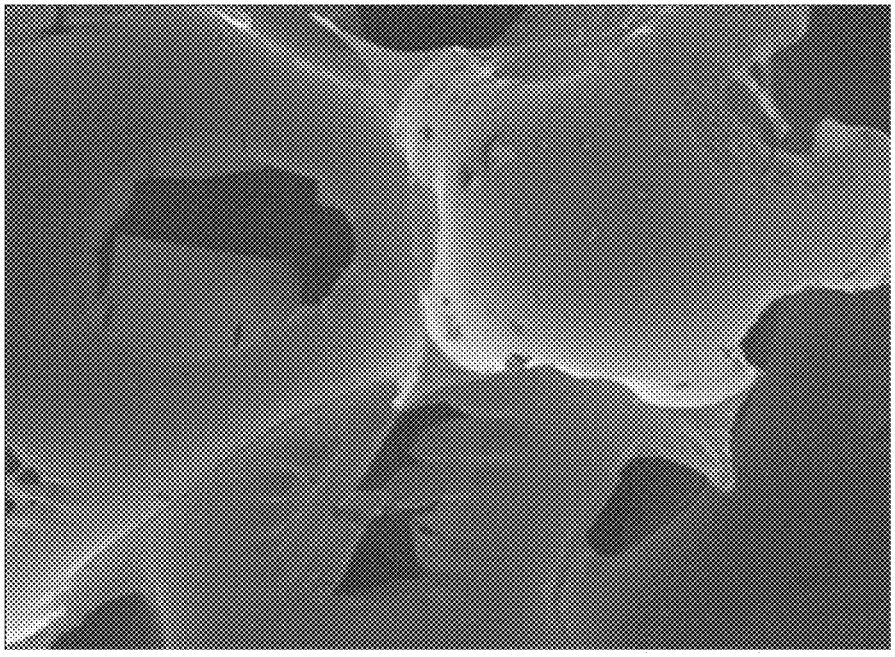
FIG. 4B is an image of an example of the foam elastic layer captured by a scanning electron microscope.

FIG. 4A is an image obtained by imaging a part of an exposed surface with a confocal microscope from the top in an example of the foam elastic layer 104. FIG. 4B is an image obtained by imaging a part of an exposed surface with a scanning electron microscope from the top in an example of the foam elastic layer 104.

A in FIG. 4A is a pore of the foam elastic layer 104.

B in FIG. 4A is a cell skeleton of the foam elastic layer 104.

C in FIG. 4A is a tip portion of the cell skeleton protruding on a surface of the foam elastic layer 104, and a circle indicated by a dotted line is a circumscribed circle of the tip portion.

A part of the cell skeleton protrudes on the surface of the foam elastic layer 104. The cell skeleton is a structure part that configures a partition wall of the pore of the foam elastic layer 104. A method of obtaining a diameter of the tip portion of the cell skeleton protruding on the surface of the foam elastic layer 104 is as described below.

A band-shaped foam elastic member that manufactures the foam elastic layer 104 is prepared or the foam elastic layer 104 peeled from the cleaning body 100 is prepared.

A surface that configures the exposed surface in the cleaning body 100 is observed from the top using a confocal microscope (for example, OPTELICS HYBRID$^{+}$, Lasertec Corporation). A portion where the cell skeleton protrudes in a width direction central portion of the foam elastic layer 104 is selected, and imaging is performed while focusing on a tip portion of the portion. Imaging places are ten places from a place near one end to a place near the other end in a length direction of the foam elastic layer 104 at substantially regular intervals. The captured images are subjected to image analysis, an arithmetical mean of a diameter of a circumscribed circle of the tip portion of the cell skeleton at the ten places is obtained, and the arithmetical mean is set to the diameter of the tip portion of the cell skeleton. In a case where the cleaning body 100 has a plurality of stripes of foam elastic layers 104, the diameter of the tip portion of the cell skeleton is obtained for each stripe.

In the cleaning body 100, the diameter of the tip portion of the cell skeleton protruding on the surface of the foam elastic layer 104 is equal to or less than 50 μm, and the value of $X \times Y^2$ is equal to or greater than 45, whereby the foam elastic layer 104 is hardly peeled and cleaning performance on a body to be cleaned is excellent. The reason is presumed as described below.

A case where the diameter of the tip portion of the cell skeleton protruding on the surface of the foam elastic layer 104 is equal to or less than 50 μm means that there is a pointed structure part on the surface, and an effect of scrapping off a stain of the body to be cleaned is high due to the pointed structure part.

A case where the diameter of the tip portion of the cell skeleton protruding on the surface of the foam elastic layer 104 is equal to or less than 50 μm means that there is also a pointed structure part on the surface of the adhesive layer 106 side, and adhesiveness to the adhesive layer 106 is excellent due to an anchor effect with the pointed structure part.

A case where the value of $X \times Y^2$ of the foam elastic layer 104 is equal to or greater than 45 means that a cleaning effect with compression and deformation of the foam elastic layer 104 can be sufficiently expected.

On the other hand, the value of $X \times Y^2$ of the foam elastic layer 104 is equal to or greater than 45. Thus, the force of deformation and restoration of the foam elastic layer 104 accompanied by being wound around the core 102 in a helical shape (that is, the force that the foam elastic layer 104 is peeled from the adhesive layer 106) also increases; however, the adhesion of the foam elastic layer 104 to the adhesive layer 106 is maintained with the pointed structure part.

In a case where the cleaning body 100 has a plurality of stripes of foam elastic layers 104, in regard to all the foam elastic layers 104 having the value of $X \times Y^2$ equal to or greater than 45, the diameter of the tip portion of the cell skeleton protruding on the surface thereof needs to be equal to or less than 50 μm.

In a case where the cleaning body 100 has the foam elastic layer 104 having the value of $X \times Y^2$ less than 45, the diameter of the tip portion of the cell skeleton protruding on the surface of the foam elastic layer is not limited, that is, may be equal to or less than 50 μm or may be greater than 50 μm.

The diameter of the tip portion of the cell skeleton protruding on the surface of the foam elastic layer 104 is, for example, equal to or less than 50 μm, preferably equal to or less than 48 μm, and more preferably equal to or less than 45 μm from a viewpoint of the anchor effect with respect to the adhesive layer 106 and the effect of scrapping off the stain of the body to be cleaned.

The diameter of the tip portion of the cell skeleton protruding on the surface of the foam elastic layer 104 is, for example, preferably equal to or greater than 30 μm, more preferably equal to or greater than 33 μm, and still more preferably equal to or greater than 35 μm from a viewpoint of the strength of the tip portion.

The number of tip portions of the cell skeleton protruding on the surface of the foam elastic layer 104 is, for example, preferably equal to or greater than 10/mm$^2$, more preferably equal to or greater than 20/mm$^2$, and still more preferably equal to or greater than 30/mm$^2$ from a viewpoint that the foam elastic layer 104 is hardly peeled from the adhesive layer 106 and cleaning performance on the body to be cleaned is excellent.

The number of tip portions of the cell skeleton protruding on the surface of the foam elastic layer 104 is, for example, preferably equal to or less than 60/mm$^2$, more preferably equal to or less than 50/mm$^2$, and still more preferably equal to or greater than 30/mm$^2$ and equal to or less than 40/mm$^2$ from a viewpoint of suppressing fixing to the body to be cleaned.

The value of $X \times Y^2$ of the foam elastic layer 104 is, for example, preferably equal to or greater than 45, more preferably equal to or greater than 65, still more preferably equal to or greater than 85, and further preferably equal to or greater than 100 from a viewpoint that the cleaning performance on the body to be cleaned is excellent.

The value of $X \times Y^2$ of the foam elastic layer 104 is, for example, equal to or less than 450, more preferably equal to or less than 400, and still more preferably equal to or less than 300 from a viewpoint that the foam elastic layer 104 is hardly peeled from the adhesive layer 106.

The inner peripheral length X of the foam elastic layer 104 in the cross section of the core 102 in the radial direction is, for example, equal to or greater than 4 mm, more preferably equal to or greater than 6 mm, and still more preferably equal to or greater than 8 mm from a viewpoint that the foam elastic layer 104 is hardly peeled from the adhesive layer 106 and cleaning performance on the body to be cleaned is excellent.

The inner peripheral length X of the foam elastic layer 104 in the cross section of the core 102 in the radial direction is, for example, preferably equal to or less than 14 mm, more preferably equal to or less than 12 mm, and still more preferably equal to or less than 10 mm from a viewpoint of stabilizing winding work.

The thickness Y of the foam elastic layer 104 is, for example, equal to or greater than 1 mm, more preferably, equal to or greater than 2 mm, and still more preferably equal to or greater than 4 mm from a viewpoint that the cleaning performance on the body to be cleaned is excellent.

The thickness Y of the foam elastic layer 104 is, for example, preferably equal to or less than 8 mm, more preferably equal to or less than 7 mm, and still more preferably equal to or less than 6 mm from a viewpoint of stabilizing winding work.

A helical angle θ of the foam elastic layer 104 is, for example, preferably greater than 15° and equal to or less than 45° from a viewpoint that the foam elastic layer 104 is hardly peeled from the adhesive layer 106 and the cleaning performance on the body to be cleaned is excellent. As shown in FIG. 2, the helical angle θ means an angle (acute angle) at which a longitudinal direction P (helical direction) of the foam elastic layer 104 crosses an axial direction Q of the core 102.

In a case where the helical angle θ is greater than 15°, the foam elastic layer 104 hardly receives resistance at the time of being brought into contact with the body to be cleaned, and the foam elastic layer 104 is retrained from being peeled. In a case where the helical angle θ is greater than 15°, the number of turns of the foam elastic layer 104 is comparatively large, and the cleaning performance on the body to be cleaned is excellent. From such viewpoints, the helical angle θ is, for example, preferably equal to or greater than 18°, and more preferably equal to or greater than 20°.

In a case where the helical angle θ is equal to or less than 45°, the force of deformation and restoration of the foam elastic layer 104 is suppressed, and the foam elastic layer 104 is restrained from being peeled. From this viewpoint, the helical angle θ is, for example, more preferably equal to or less than 40° and still more preferably equal to or less than 35°.

The number of turns of the foam elastic layer 104 with respect to the core 102 is, for example, equal to or greater than 3, more preferably equal to or greater than 4, and still more preferably equal to or greater than 5 from a viewpoint that the cleaning performance on the body to be cleaned is excellent and the cleaning body 100 easily rotates following the body to be cleaned. An upper limit of the number of turns of the foam elastic layer 104 depends on the length of the core 102 and is thus particularly limited.

A coverage of the foam elastic layer 104 with respect to the core 102 is, for example, preferably equal to or greater than 30%, more preferably equal to or greater than 35%, and still more preferably equal to or greater than 40% from a viewpoint that the cleaning performance of the body to be cleaned is excellent.

The coverage of the foam elastic layer 104 with respect to the core 102 is, for example, preferably equal to or less than 70%, more preferably equal to or less than 65%, and still more preferably equal to or less than 55% from a viewpoint that an adhesive substance attached to the surface of the foam elastic layer 104 is restrained from being retransferred to the body to be cleaned.

The coverage is {width W1 of foam elastic layer 104 (width W1 of foam elastic layer 104+interval W2 of foam elastic layer 104)}. As shown in FIG. 2, the width W1 and the interval W2 of the foam elastic layer 104 mean the length of the foam elastic layer 104 and a length between the foam elastic layers 104 along the axial direction Q of the core 102.

The width W1 of the foam elastic layer 104 is, for example, preferably equal to or greater than 5 mm and equal to or less than 25 mm, more preferably equal to or greater than 6 mm and equal to or less than 20 mm, and still more preferably equal to or greater than 8 mm and equal to or less than 15 mm.

Hereinafter, materials of the core 102, the foam elastic layer 104, and the adhesive layer 106 will be described.

Core 102

Examples of the material of the core 102 include metal, an alloy, and resin. Examples of metal or the alloy include metal, such as iron (free-cutting steel or the like), copper, brass, aluminum, and nickel; and an alloy, such as stainless steel. Examples of resin include polyacetal resin and polycarbonate resin. One kind of resin may be used alone or two or more kinds of resin may be used in combination.

The surface of the core 102 may be subjected to surface treatment. In a case where the core 102 is formed of metal, for example, it is desirable that plating is performed. In a case where the core 102 is formed of a material (for example, resin) having no conductivity, conductive treatment, such as plating, may be performed.

Foam Elastic Layer 104

It is preferable that the foam elastic layer 104 is, for example, a layer that is restored to an original shape even though deformation occurs due to external force application of 100 Pa.

Examples of the material of the foam elastic layer 104 include formable resin, such as polyurethane, polyethylene, polyamide, or polypropylene; or a rubber material, such as silicone rubber, fluororubber, urethane rubber, ethylene-propylene-diene rubber (EPDM), acrylonitrile-butadiene rubber (NBR), chloroprene rubber (CR), chlorinated polyisoprene, isoprene, styrene-butadiene rubber, hydrogenated polybutadiene, or butyl rubber. One kind of material may be used alone or two or more kinds of materials may be used in combination. A foaming agent, a foaming auxiliary, a foam stabilizer, a catalyst, a curing agent, a plasticizer, a vulcanizing agent, a vulcanizing auxiliary, a vulcanization accelerator, or the like may be added to such materials.

It is preferable that the foam elastic layer 104 is, for example, polyurethane foam resistant to stretching from a viewpoint that a surface of the body to be cleaned is not damaged due to friction and the occurrence of tearing or breakage is suppressed over a long period of time.

Examples of polyurethane foam include a reaction product of polyol (for example, polyester polyol, polyether-polyol, or acrylic polyol) with isocyanate (for example, 2,4-tolylene diisocyanate, 2,6-tolylene diisocyanate, 4,4-diphenylmethane diisocyanate, tolidine diisocyanate, or 1,6-hexamethylene diisocyanate), and a reaction product further with a chain extender (1,4-butanediol or trimethylolpropane). Foaming of polyurethane is generally performed, for example, using water or a foaming agent, such as an azo compound (for example, azodicarbonamide or azobisisobutyronitrile). A foaming auxiliary, a foam stabilizer, a catalyst, or the like may be added to polyurethane foam.

Density of the foam elastic layer 104 is, for example, preferably equal to or greater than 60 kg/m$^3$ and equal to or less than 100 kg/m$^3$, more preferably equal to or greater than 65 kg/m$^3$ and equal to or less than 95 kg/m$^3$, and still more preferably equal to or greater than 70 kg/m$^3$ and equal to or less than 90 kg/m$^3$.

The number of cells of the foam elastic layer 104 is, for example, preferably equal to or greater than 80/25 mm and equal to or less than 105/25 mm, more preferably equal to or greater than 85/25 mm and equal to or less than 100/25 mm, and still more preferably equal to or greater than 90/25 mm and equal to or less than 95/25 mm. The number of cells of the foam elastic layer 104 is obtained following JIS K 6400-1: 2004 (Annex 1).

Adhesive Layer 106

The material of the adhesive layer 106 is not particularly limited as long as the core 102 and the foam elastic layer 104 can be adhered. Examples of the adhesive layer 106 include a double-sided tape and an adhesive.

Manufacturing Method of Cleaning Body 100

Figure 5A:
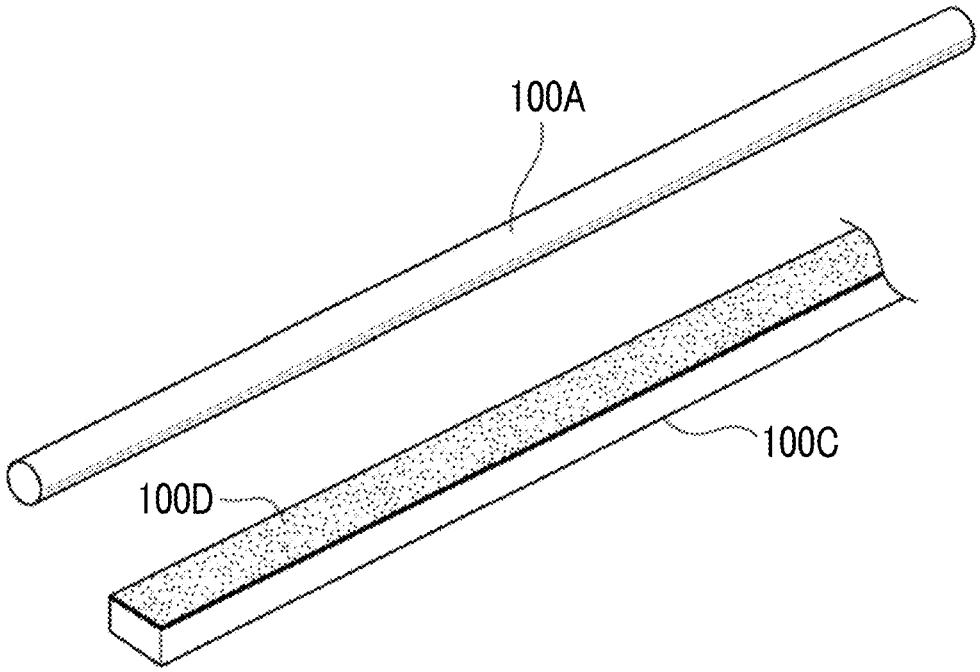
FIG. 5A is a process view showing an example of a manufacturing method of the cleaning body according to the present exemplary embodiment.
Figure 5B:
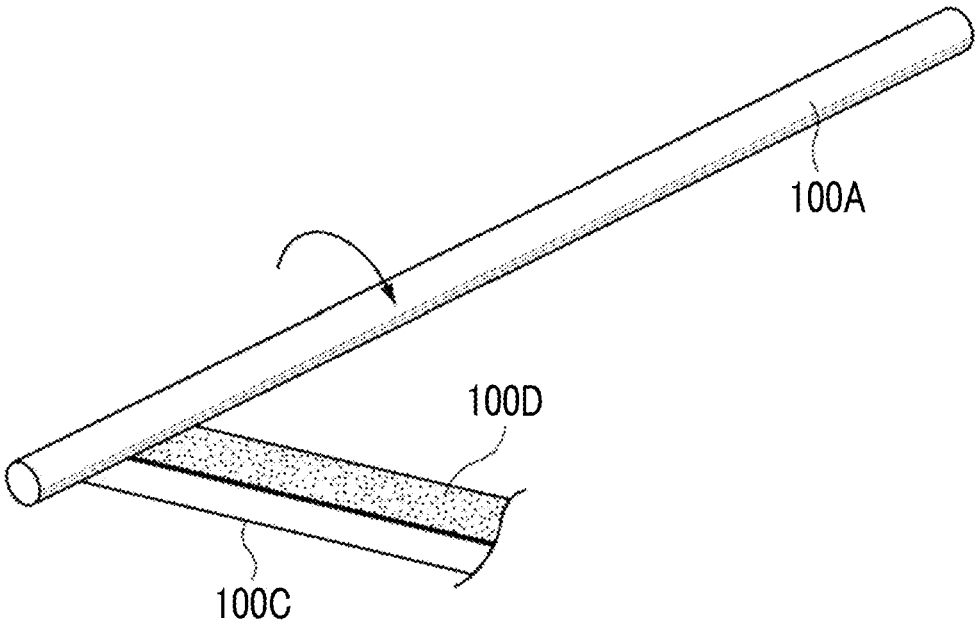
FIG. 5B is a process view showing an example of the manufacturing method of the cleaning body according to the present exemplary embodiment.
Figure 5C:
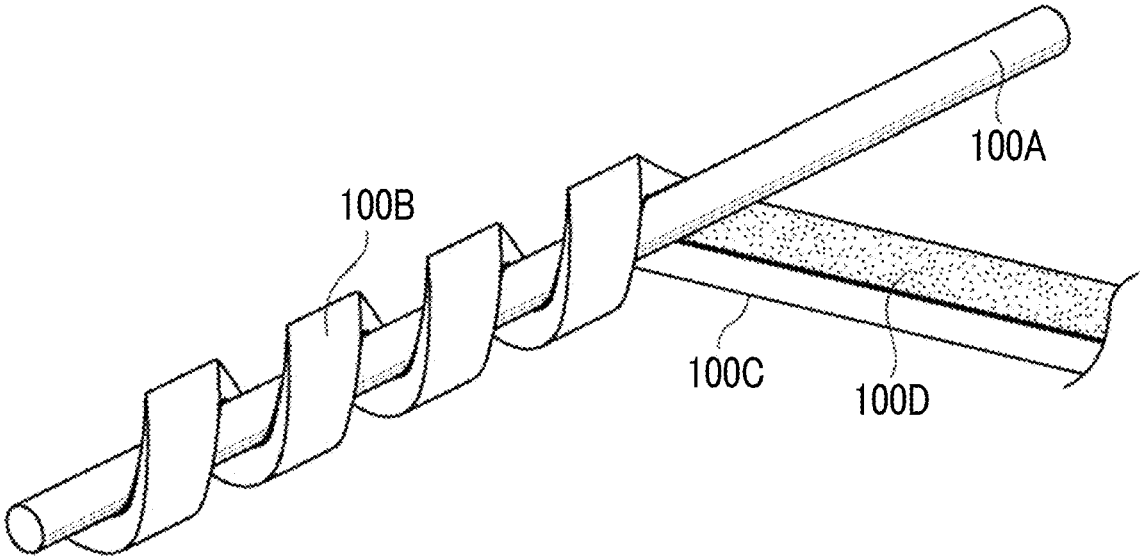
FIG. 5C is a process view showing an example of the manufacturing method of the cleaning body according to the present exemplary embodiment.

FIGS. 5A, 5B, and 5C are process views showing an example of a manufacturing method of the cleaning body 100.

First, a foam elastic material (for example, polyurethane foam) is thinly sliced at an intended thickness, and a foam elastic sheet (for example, polyurethane foam sheet). To control the diameter of the tip portion of the cell skeleton protruding on the surface of the foam elastic layer to be equal to or less than 50 μm, for example, grinding of the surface is performed in thinly slicing the foam elastic material.

Next, a double-sided tape is attached to one surface of the foam elastic sheet. A band-shaped foam elastic member having intended length and width is cut from the foam elastic sheet with the double-sided tape. The double-sided tape may be attached to one surface after the band-shaped foam elastic member is cut from the foam elastic sheet. With the above treatment, a band-shaped member (see FIG. 5A) in which a double-sided tape 100D is attached to one surface of a band-shaped foam elastic member 100C is obtained.

A core 100A that is a rod-shaped member is prepared. The core 100A corresponds to the core 102 of the cleaning body 100.

A length of the foam elastic member 100C is decided by an axial direction length of the core 100A, a winding angle (the helical angle θ in the cleaning body 100) of the foam elastic member 100C, and tension in winding the foam elastic member 100C.

Next, the foam elastic member 100C is placed on a stage such that the surface on which the double-sided tape 100D is attached turns upward, and one end of a release liner of the double-sided tape 100D is peeled. Next, as shown in FIG. 5B, one end portion of the core 100A is placed on the double-sided tape 100D with the release liner peeled. In this case, positions of the core 100A and the foam elastic member 100C are decided such that the helical angle θ in the cleaning body 100 is realized.

Next, the core 100A is rotated and the foam elastic member 100C is wound around an outer peripheral surface of the core 100A in a helical shape while peeling the release liner of the double-sided tape 100D (see FIG. 5C), and a foam elastic layer 100B (the foam elastic layer 104 in the cleaning body 100) is disposed on the outer peripheral surface of the core 100A in a helical shape.

From a viewpoint of reducing the force of restoration of the foam elastic layer 104 in the cleaning body 100 and restraining a longitudinal direction end portion of the foam elastic layer 104 from being peeled from the core 102, for example, it is preferable that the foam elastic member 100C is wound around the core 100A while suppressing a degree of elastic deformation of the foam elastic member 100C (change in thickness of the member). Specifically, for example, it is desirable that an angle of winding the foam elastic member 100C and tension in winding the foam elastic member 100C are controlled depending on a thickness of the foam elastic member 100C.

In a case of applying tension in winding the foam elastic member 100C around the core 100A, tension is applied to such an extent that no gap occurs between the foam elastic member 100C and the double-sided tape 100D. Specifically, for example, it is desirable that tension is applied in such a manner that the length of the foam elastic member 100C is greater than 100% and equal to or less than 105%. In a case where tension is excessively applied, the force of restoration of the foam elastic layer 104 in the cleaning body 100 is hardly suppressed, tensile permanent elongation increases, and elastic force of the foam elastic layer 104 required for cleaning tends to be reduced.

In a case where the foam elastic member 100C is wound around the core 100A, the foam elastic member 100C tends to be elongated. The elongation is different in a thickness direction of the foam elastic member 100C, and an outermost part is most elongated. The elongation is controlled by a curvature radius at which the foam elastic member 100C is wound around the core 100A and the thickness of the foam elastic member 100C, and the curvature radius at which the foam elastic member 100C is wound around the core 100A is controlled by an outer diameter of the core 100A and the winding angle of the foam elastic member 100C. Specifically, for example, it is desirable that an outermost part of the foam elastic layer 104 in the cleaning body 100 is elongated about 105% with respect to the outermost part of foam elastic member 100C. In a case where the outermost part of the foam elastic layer 104 is excessively elongated, the elastic force of the foam elastic layer 104 in the cleaning body 100 may be reduced.

The curvature radius at which the foam elastic member 100C is wound around the core 100A is, for example, preferably equal to or greater than {(core outer diameter/2)+0.2 mm} and equal to or less than {(core outer diameter/2)+8.5 mm}, and more preferably equal to or greater than {(core outer diameter/2)+0.5 mm} and equal to or less than {(core outer diameter/2)+7.0 mm}.

Cleaning Device

A cleaning device according to the present exemplary embodiment has a cleaning body and a body to be cleaned. The body to be cleaned is a rotating member, and the cleaning body is a member that cleans the body to be cleaned while rotating in contact with the rotating body to be cleaned. As the cleaning body, the cleaning body according to the present exemplary embodiment is applied.

The cleaning device according to the present exemplary embodiment is, for example, a cartridge type cleaning device that is attached and detached to and from an electrophotographic image forming apparatus. Examples of the body to be cleaned include a charging body, a transfer roller, a transfer belt, and a transport belt. Toner, paper dust, or the like stuck to a surface of the body to be cleaned is removed by the cleaning body.

Image Forming Apparatus, Assembly, Charging Device

Figure 6:
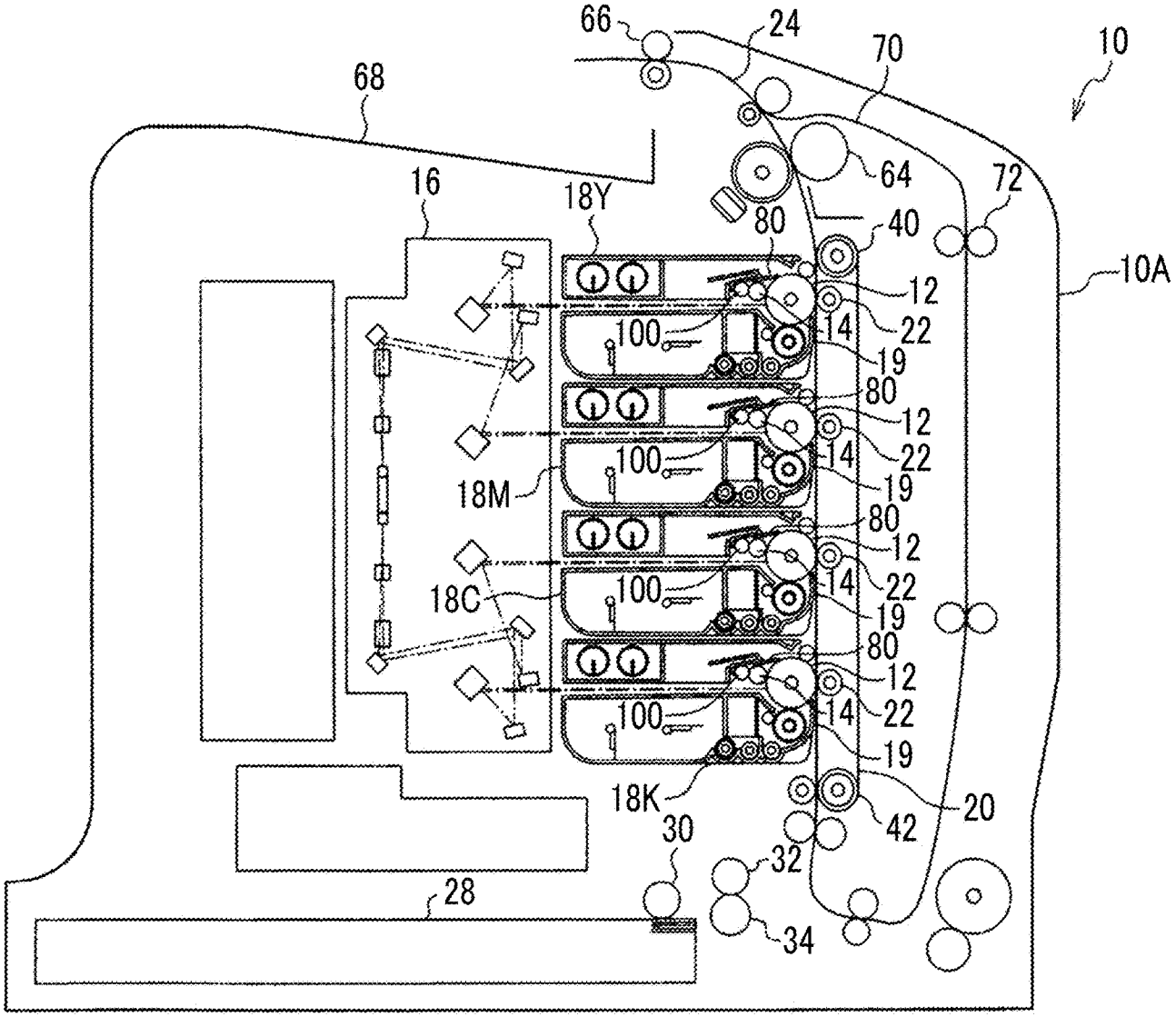
FIG. 6 is a schematic configuration diagram showing an example of an image forming apparatus according to the present exemplary embodiment.
Figure 7:
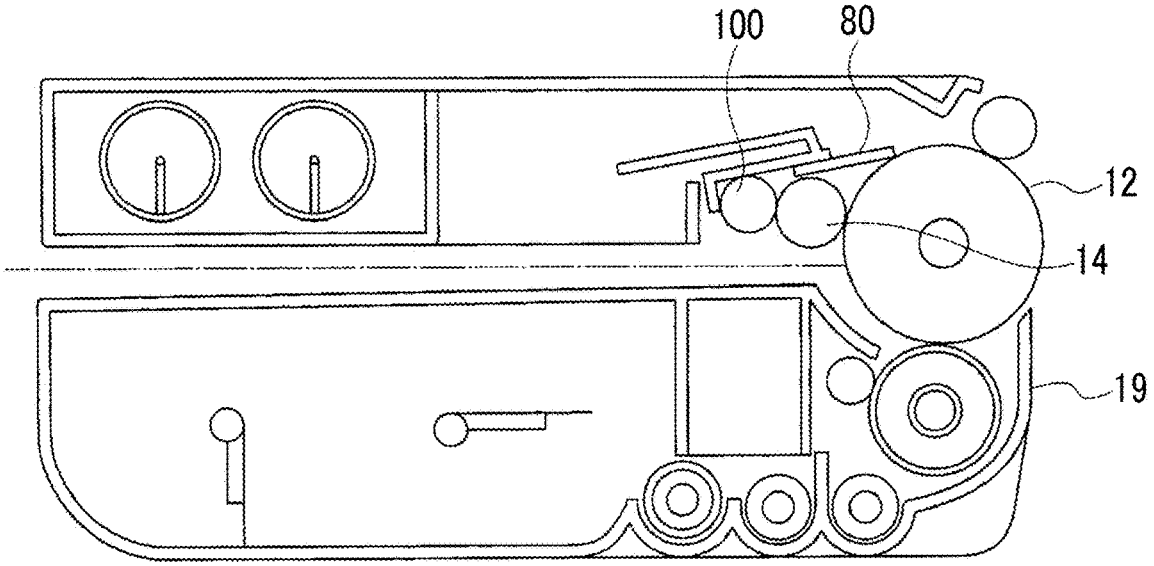
FIG. 7 is a schematic configuration diagram showing an example of an assembly according to the present exemplary embodiment.
Figure 8:
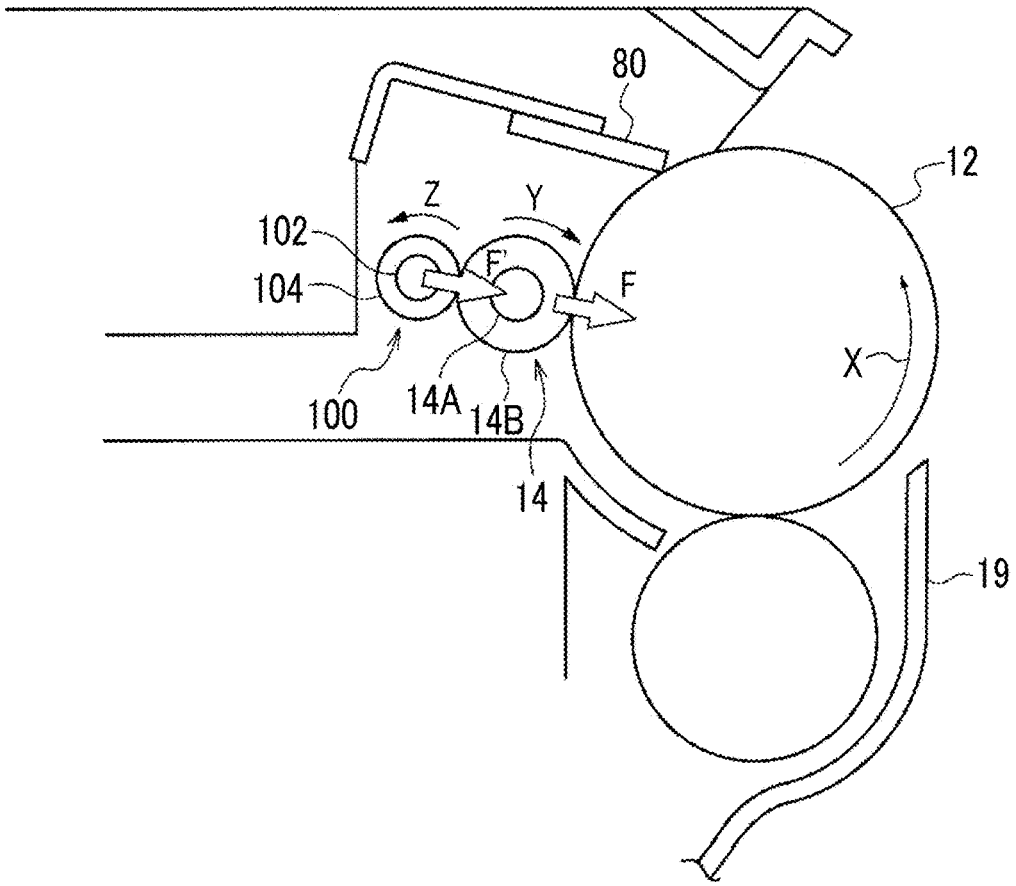
FIG. 8 is a schematic configuration diagram of a peripheral portion of a charging device in FIGS. 6 and 7 on an enlarged scale.

FIG. 6 is a schematic configuration diagram showing an example of an image forming apparatus according to the present exemplary embodiment. FIG. 7 is a schematic configuration diagram showing an example of an assembly according to the present exemplary embodiment. FIG. 8 is a schematic configuration diagram showing a peripheral portion of the charging device in FIGS. 6 and 7 on an enlarged scale.

An image forming apparatus 10 shown in FIG. 6 is a tandem type and direct transfer type color image forming apparatus. Inside an apparatus body 10A of the image forming apparatus 10, process cartridges 18Y, 18M, 18C, and 18K for yellow (Y), magenta (M), cyan (C), and black (K) are provided.

Each of the process cartridges 18Y, 18M, 18C, and 18K is an assembly that is attachable and detachable to and from the image forming apparatus 10, and is an example of an assembly according to the present exemplary embodiment. For example, as shown in FIGS. 6 and 7, each of the process cartridges 18Y, 18M, 18C, and 18K has a photosensitive member 12, a charging body 14, and a developing device 19.

The photosensitive member 12 is rotationally driven by a motor (not shown). The surface of the photosensitive member 12 is charged by the charging body 14 disposed on the surface of the photosensitive member 12. After charging, the photosensitive member 12 is subjected to exposure with a laser beam emitted from the exposure device 16 downstream of the photosensitive member 12 in a rotation direction, and an electrostatic image is formed on the photosensitive member 12. The electrostatic image formed on the photosensitive member 12 is developed by the developing device 19 to form a toner image. Each step of charging, exposure, and development is performed on the surface of the photosensitive member 12 of each color, and a toner image corresponding to each color is formed on the surface of the photosensitive member 12.

The toner image formed on the photosensitive member 12 is transferred to a recording medium 24 that is transported on a transport belt 20, at a place where the photosensitive member 12 and a transfer member 22 are in contact with each other via the transport belt 20. The transfer member 22 is, for example, a roller including a conductive elastic layer on an outer peripheral surface of a conductive support, and the conductive support is rotatably supported in the image forming apparatus 10. The transport belt 20 is supported from an inner peripheral surface while tension is applied with support rollers 40 and 42, and transports the recording medium 24. The recording medium 24 is drawn out from a storage container 28 by a drawing roller 30 and is transported to the transport belt 20 by transport rollers 32 and 34.

The toner images of the colors are transferred to the recording medium 24 in the arrangement order of the four process cartridges, that is, in an order of black (K), cyan (C), magenta (M), and yellow (Y).

The recording medium 24 to which the toner images are transferred is transported to a fixing device 64, and the toner images are heated and pressurized by the fixing device 64 to be thus fixed on the recording medium 24. Thereafter, in a case of one-sided printing, the recording medium 24 on which the toner images are fixed is discharged onto a discharge part 68 provided in an upper portion of the image forming apparatus 10 by a discharge roller 66. In a case of double-sided printing, the recording medium 24 with the toner images fixed on a first surface (front surface) is transported to a transport path 70 for double-sided printing by reverse rotation of the discharge roller 66. Thereafter, the recording medium 24 is transported onto the transport belt 20 again by a transport roller 72 provided in the transport path 70 in a state in which the recording medium 24 is reversed upside down, and the toner images are transferred from the photosensitive member 12 to a second surface (back surface) of the recording medium 24. Then, the recording medium 24 with the toner images transferred to the second surface (back surface) is transported to the fixing device 64, and the toner images are fixed on the recording medium 24 by the fixing device 64. Thereafter, the recording medium 24 with the toner images fixed to both surfaces is discharged onto the discharge part 68 by the discharge roller 66.

After completion of the transfer of the toner images, each time the photosensitive member 12 rotates once, residual toner, paper dust, or the like on the surface of the photosensitive member 12 is removed by a cleaning blade 80, and the photosensitive member 12 is ready for subsequent image formation.

For example, as shown in FIG. 8, the charging body 14 is a roller member including a conductive elastic layer 14B on an outer peripheral surface of a support 14A. The support 14A is a cylindrical body or a columnar body having conductivity. The support 14A is rotatably supported in the image forming apparatus. The conductive elastic layer 14B is laminated on the outer peripheral surface of the support 14A in a cylindrical shape. The conductive elastic layer 14B is, for example, a layer in which a conducting agent is dispersed in a foam or non-foam rubber material.

On a side of the charging body 14 opposite to the photosensitive member 12, the cleaning body 100 of the charging body 14 is disposed in contact with the charging body 14. That is, the charging body 14 and the cleaning body 100 configure a charging device (unit) (see FIGS. 7 and 8). As the cleaning body 100, a cleaning body according to the present exemplary embodiment is used. The cleaning body 100 may be, for example, any one of a member that is constantly in contact with the charging body 14 and rotates following the charging body 14, a member that is brought into contact with the charging body 14 only at the time of cleaning and rotate following the charging body 14, or a member that is brought into contact with the charging body 14 only at the time of cleaning and rotates with separate drive.

For example, as shown in FIG. 8, a load F is applied to both ends of the support 14A, whereby the charging body 14 is pressed on the photosensitive member 12. With this, the conductive elastic layer 14B is elastically deformed and forms a nip portion along the outer peripheral surface of the photosensitive member 12.

For example, as shown in FIG. 8, a load F' is applied to both ends of the core 102, whereby the cleaning body 100 is pressed on the charging body 14. With this, the foam elastic layer 104 is elastically deformed to form a nip portion along the outer peripheral surface of the charging body 14.

In the configuration example shown in FIG. 8, the photosensitive member 12 is rotationally driven in an arrow X direction by a motor (not shown), and the charging body 14 is rotated in an arrow Y direction following the rotation of the photosensitive member 12. The cleaning body 100 is rotated in an arrow Z direction following the rotation of the charging body 14.

Although the examples of the image forming apparatus and the process cartridge according to the present exemplary embodiment have been described referring to FIGS. 6, 7, and 8, the present exemplary embodiment is not limited thereto.

The image forming apparatus according to the present exemplary embodiment is not limited to a tandem type and direct transfer type shown in FIG. 6, and a known image forming apparatus, such as an intermediate transfer type, is applied. In the image forming apparatus according to the present exemplary embodiment, the internal devices or member need not to be assembled into a cartridge, but each may be directly disposed.

A process cartridge including a charging device may be a process cartridge that includes a charging device (a unit of a charging body and a cleaning body), and further includes at least one selected from a photosensitive member, an exposure device, a developing device, or a transfer device.

The body to be cleaned of which the surface is cleaned by the cleaning body according to the present exemplary embodiment is not limited to the charging body. Examples of the body to be cleaned include a photosensitive member, a transfer member, a sheet transport belt, an intermediate transfer type secondary transfer member (for example, a secondary transfer roller), and an intermediate transfer type intermediate transfer member (for example, an intermediate transfer belt). The body to be cleaned and the cleaning body that is disposed in contact with the body to be cleaned may be assembled into a unit to configure a process cartridge that is attachable and detachable to and from the image forming apparatus.

Hereinafter, an exemplary embodiment example where of a charging body (that is, a charging body provided in a charging device according to the present exemplary embodiment) will be described in detail as an example of a body to be cleaned of which the surface is cleaned by a cleaning body according to the present exemplary embodiment.

The charging body has, for example, a support and a conductive elastic layer. The conductive elastic layer may be a single layer or may be a laminate in which a plurality of layers are laminated. The conductive elastic layer may be a layer of which the surface is subjected to surface treatment or may be a surface layer containing a polymer material may be further laminated on an outer peripheral surface of the conductive elastic layer.

Examples of the material of the support include free-cutting steel and stainless steel, and the surface of the support may be subjected to plating. In a case of a material having no conductivity, conductive treatment, such as plating, may be performed.

The conductive elastic layer contains an elastic material such as rubber, and a conducting agent, such as carbon black or ion-conducting agent, and for example, the conducting agent is dispersed and blended in the elastic material. The conductive elastic layer may further contain a softening agent, a plasticizer, a curing agent, a vulcanizing agent, a vulcanizing auxiliary, a vulcanization accelerator, an anti-oxidant, a lubricant, and a filler (silica, calcium carbonate, or the like). The conductive elastic layer is formed by coating a mixture of the above-described materials on the outer peripheral surface of the conductive support. The elastic material may be a foam, and in this case, the conductive elastic layer is a conductive foam elastic layer.

Examples of the elastic material that forms the conductive elastic layer include silicone rubber, ethylene propylene rubber, epichlorohydrin rubber, epichlorohydrin-ethylene oxide copolymer rubber, epichlorohydrin-ethylene oxide-allyl glycidyl ether copolymer rubber, acrylonitrile-butadiene copolymer rubber, and a mixture thereof. One kind of elastic material may be used alone or two or more kinds of elastic materials may be used in combination.

Examples of the conducting agent include an electron-conducting agent and an ion-conducting agent. Examples of the electron-conducting agent include particles or powder formed of carbon black, such as KETJENBLACK or acetylene black; pyrolytic carbon or graphite; conductive metal or alloy, such as aluminum, copper, nickel, or stainless steel; conductive metal oxide, such as tin oxide, indium oxide, titanium oxide, tin oxide-antimony oxide solid solution, or tin oxide-indium oxide solid solution; and a substance obtained by subjecting the surface of an insulating substance to conductive treatment. Examples of the ion-conducting agent include perchlorates and chlorates of oniums, such as tetraethylammonium and lauryltrimethylammonium; and perchlorates and chlorates of alkali metals and alkaline earth metals, such as lithium and magnesium.

One kind of conducting agent may be used alone or two or more kinds of conducting agents may be used in combination. The amount of the conducting agent blended is not particularly limited. It is desirable that, for example, the amount of the electron-conducting agent blended is in a range equal to or greater than 1 part by mass and equal to or less than 60 parts by mass with respect to 100 parts by mass of the elastic material, and the amount of the ion-conducting agent blended is a range equal to or greater than 0.1 parts by mass and equal to or less than 5.0 parts by mass with respect to 100 parts by mass of the elastic material.

A surface layer containing a polymer material may be provided on the surface of the charging body. Examples of the polymer materials contained in the surface layer include polyvinylidene fluoride, tetrafluoroethylene copolymer, polyester, polyimide, copolymer nylon, and silicone-based resin. One kind of polymer material may be used alone or two or more kinds of polymer materials may be used in combination.

A conductive material may be contained in the surface layer to adjust a resistance value. Examples of the conductive material include carbon black, conductive metal oxide particles, and an ion-conducting agent. One kind of conductive material may be used alone or two or more kinds of conductive materials may be used in combination. The surface layer may contain insulating particles, such as alumina or silica.

EXAMPLES

Hereinafter, although the exemplary embodiment of the present invention will be described in detail in connection with Examples, the exemplary embodiment of the present invention is not limited to Examples. In the following description, "part" and "%" are on a mass basis unless otherwise specified. In the following description, composition, treatment, manufacturing, and the like are performed at a room temperature (25° C.±3° C.)

Preparation of Charging Roller

Formation of Conductive Elastic Layer

- Epichlorohydrin-ethylene oxide-allyl glycidyl ether copolymer rubber (GECHRON3106, Zeon Corporation) 100 parts
- Carbon black (Asahi Thermal, Asahi Carbon Co., Ltd.) 25 parts
- KETJENBLACK EC (Lion Specialty Chemicals Co., Ltd.) 8 parts
- Ion-conducting agent (lithium perchlorate) 1 part
- Sulfur (200 mesh, Tsurumi Chemical Industry Co., Ltd.) 1 part
- Vulcanization accelerator (Nocceler DM, Ouchi Shinko Chemical Industrial Co., Ltd.) 2 parts Vulcanization accelerator (Nocceler TT, Ouchi Shinko Chemical Industrial Co., Ltd.) 0.5 parts The above-described materials are kneaded with an open roller, and a composition for forming an elastic layer is obtained. An outer peripheral surface of a support that is formed of SUS416 and has a diameter of 9 mm and a full length of 370 mm is coated with the composition for forming an elastic layer having a thickness of 1.5 mm. The obtained product is put in a cylindrical mold having an inner diameter of 12.0 mm and vulcanized at 170° C. for 30 minutes. After the vulcanized material is taken out from the mold, an outer peripheral surface of a conductive elastic layer is polished, and an elastic roller is obtained.

Formation of Surface Layer

Copolymer nylon (Amilan CM8000, Toray Industries, Inc.) 20 parts

Antimony-doped tin oxide (SN-100P, Ishihara Sangyo Kaisha, Ltd.) 30 parts

Methanol 500 parts

Butanol 240 parts

The above-described materials are dispersed with a bead mill. An obtained dispersion is applied to an outer peripheral surface of the elastic roller by dip coating and dried by heating at 140° C. for 15 minutes, and a surface layer having a thickness of 4 μm is formed. With this, a charging roller is obtained.

Preparation of Cleaning Roller

Example 1

As the core, a metal core that is formed of SUM24EZ and has a diameter of 5.0 mm and a full length of 360 mm is prepared. As a material of a foam elastic layer, urethane foam (FHS, Inoac Corporation) is prepared.

Urethane foam is thinly sliced at an intended thickness, and an urethane foam sheet is obtained. A double-sided tape having a thickness of 0.15 mm (No. 501L, Nitto Denko Corporation) is attached to the entire surface of a side of the urethane foam sheet. The urethane foam sheet with the double-sided tape is cut at intended length and width, and a band-shaped member with the double-sided tape is obtained. An exposed surface (a surface to which the double-sided tape is not attached) of the band-shaped member is observed with a confocal microscope, and a diameter of a tip portion of a cell skeleton protruding on a surface is obtained.

The band-shaped member with the double-sided tape is placed on a horizontal stage such that the release liner of the double-sided tape turns upward. The band-shaped member with the double-sided tape is wound around the metal core while removing the release liner by rolling the metal core on the stage with tension applying to the band-shaped member with the double-sided tape such that the full length of the band-shaped member is elongated by 0% to 5%. A cleaning roller is obtained accordingly. The helical angle θ of the foam elastic layer, the inner peripheral length X of the foam elastic layer in the cross section of the core in the radial direction, and the thickness Y of the foam elastic layer are as shown in Table 1.

Example 2

Except that the double-sided tape is changed to another double-sided tape (thickness of 0.15 mm) (No. 510, Nitto Denko Corporation), a cleaning roller is obtained in the same manner as in Example 1.

Example 3

Except that the double-sided tape is changed to another double-sided tape (thickness of 0.15 mm) (No. 5615, Nitto Denko Corporation), a cleaning roller is obtained in the same manner as in Example 1.

Example 4

Except that the thickness Y of the foam elastic layer is changed to a value shown in Table 1, a cleaning roller is obtained in the same manner as in Example 1.

Example 5

Except that the thickness Y of the foam elastic layer is changed to a value shown in Table 1, a cleaning roller is obtained in the same manner as in Example 1.

Example 6

Except that the inner peripheral length X of the foam elastic layer in the cross section of the core in the radial direction and the thickness Y of the foam elastic layer are changed to values shown in Table 1, a cleaning roller is obtained in the same manner as in Example 1.

Example 7

Except that the inner peripheral length X of the foam elastic layer in the cross section of the core in the radial direction and the thickness Y of the foam elastic layer are changed to values shown in Table 1, a cleaning roller is obtained in the same manner as in Example 1.

Comparative Example 1

Except that the material of the foam elastic layer is changed to another urethane foam (EP70, Inoac Corporation), a cleaning roller is obtained in the same manner as in Example 1.

Comparative Example 2

Except that the inner peripheral length X of the foam elastic layer in the cross section of the core in the radial direction is changed to a value shown in Table 1, a cleaning roller is obtained in the same manner as in Example 1.

Comparative Example 3

Except that the thickness Y of the foam elastic layer is changed to a value shown in Table 1, a cleaning roller is obtained in the same manner as in Example 1.

Preparation of Charging Device

The charging roller and the cleaning roller of any one of Examples or Comparative Examples are combined to assemble the charging device.

Performance Evaluation

Peeling of Foam Elastic Layer

After the cleaning roller is placed in an environment of a temperature of 50° C. and relative humidity of 75% for 30 days, both ends of the cleaning roller in the axial direction are observed. A state in which an end portion of the foam elastic layer is separated from the metal core over a length of 1 mm or more is determined as peeling. The presence or absence of peeling and the length of peeling are classified as follows. A result is shown in Table 1.

G0: There is no peeling.

G1: There is peeling, and the length of peeling is equal to or less than 10 mm.

G2: There is peeling, and the length of peeling is greater than 10 mm.

Cleaning Performance

The cleaning roller and the charging roller are disposed to be in contact with each other in a drum cartridge in an electrophotographic image forming apparatus (DocuCentre-VI C7771, FUJIFILM Business Innovation Corp.). A band-shaped image quality pattern of 320 mm in length (transport direction of paper)×30 mm in width with 100% image density is output on 20,000 sheets of A3 paper in an environment of a temperature of 32° C. and relative humidity of 85%.

A position on the surface of the charging roller facing an image quality forming position on the photosensitive member is observed with a confocal laser scanning microscope (OLS1100, Olympus Corporation). An area that is coated with an adhesive substance in an observed region of 1 $\mu m^2$ is classified as described below. A result is shown in Table 1.

G0: An adhesive substance is found in a range equal to or less than 10%.

G0.5: An adhesive substance is found in a range greater than 10% and equal to or less than 20%.

G1: An adhesive substance is found in a range greater than 20% and equal to or less than 30%.

G2: An adhesive substance is found in a range greater than 30% and equal to or less than 40%.

G3: An adhesive substance is found in a range greater than 40% and equal to or less than 50%.

Maintainability of Cleaning Performance

After the evaluation of the cleaning performance, an image quality pattern identical to the above-described image quality pattern is output on 80,000 sheets in an environment of a temperature of 10° C. and relative humidity of 15%, the surface of the charging roller is observed in the same manner, and the cleaning performance is classified with the same criteria as described above. A result is shown in Table 1.

In Table 1, a numerical value described in "adhesive force" of the adhesive layer is a value indicating adhesion performance described in a manufacturer catalog, and the greater the value, the higher the adhesion performance. The diameter of the tip portion of the cell skeleton protruding on the surface of the foam elastic layer and the value of $X \times Y^2$ of the foam elastic layer are controlled regardless of the magnitude of the adhesion performance of the adhesive layer itself, whereby peeling of the foam elastic layer is suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning body comprising:

a core;

a foam elastic layer that is disposed to be wound around an outer peripheral surface of the core in a helical shape from one end to the other end of the core; and an adhesive layer that adheres the core and the foam elastic layer, wherein a diameter of a tip portion of a cell skeleton protruding on a surface of the foam elastic layer is equal to or less than 50 μm, and in a case where an inner peripheral length of the foam elastic layer in a cross section of the core in a radial

TABLE 1

| | Foam Elastic Layer | | | | | | | Performance Evaluation | | |
|---|---|---|---|---|---|---|---|---|---|---|
| | Material — | Diameter of Tip Portion μm | θ degree | X mm | Y mm | $X \times Y^2$ — | Adhesive Force — | Peeling | Cleaning Performance | Maintainability of Cleaning Performance |
| Comparative Example 1 | Urethane Foam | 80 | 25 | 5 | 3 | 45 | 10 | G2 | G1 | G3 |
| Example 1 | Urethane Foam | 40 | 25 | 5 | 3 | 45 | 10 | G0 | G0 | G0.5 |
| Example 2 | Urethane Foam | 40 | 25 | 5 | 3 | 45 | 12 | G0 | G0 | G0.5 |
| Example 3 | Urethane Foam | 40 | 25 | 5 | 3 | 45 | 21 | G0 | G0 | G0.5 |
| Example 4 | Urethane Foam | 40 | 25 | 5 | 4 | 80 | 10 | G0 | G0 | G0 |
| Example 5 | Urethane Foam | 40 | 25 | 5 | 5 | 125 | 10 | G0 | G0 | G0 |
| Example 6 | Urethane Foam | 40 | 25 | 8 | 5 | 200 | 10 | G0 | G0 | G0 |
| Example 7 | Urethane Foam | 40 | 25 | 8 | 6 | 288 | 10 | G0 | G0 | G0 |
| Comparative Example 2 | Urethane Foam | 40 | 25 | 3 | 3 | 27 | 10 | G1 | G1 | G2 |
| Comparative Example 3 | Urethane Foam | 40 | 25 | 5 | 2 | 20 | 10 | G0 | G1 | G2 |

direction is X (mm), and a thickness of the foam elastic layer is Y (mm), a value of $X \times Y^2$ is equal to or greater than 45.

2. The cleaning body according to claim 1, wherein the value of $X \times Y^2$ is equal to or less than 450.

3. The cleaning body according to claim 1, wherein the value of $X \times Y^2$ is equal to or greater than 80 and equal to or less than 300.

4. The cleaning body according to claim 1, wherein X is equal to or greater than 4 mm and equal to or less than 14 mm.

5. The cleaning body according to claim 1, wherein X is equal to or greater than 8 mm and equal to or less than 12 mm.

6. The cleaning body according to claim 1, wherein Y is equal to or greater than 1 mm and equal to or less than 8 mm.

7. The cleaning body according to claim 1, wherein Y is equal to or greater than 4 mm and equal to or less than 6 mm.

8. The cleaning body according to claim 1, wherein the diameter of the tip portion of the cell skeleton protruding on the surface of the foam elastic layer is equal to or greater than 30 μm and equal to or less than 50 μm.

9. The cleaning body according to claim 1, wherein the diameter of the tip portion of the cell skeleton protruding on the surface of the foam elastic layer is equal to or greater than 35 μm and equal to or less than 45 μm.

10. The cleaning body according to claim 1, wherein a helical angle θ of the foam elastic layer is greater than 15°.

11. The cleaning body according to claim 1, wherein a helical angle θ of the foam elastic layer is equal to or greater than 20° and equal to or less than 40°.

12. A cleaning device comprising:

a body to be cleaned; and the cleaning body according to claim 1, the cleaning body cleaning the body to be cleaned while rotating in contact with the body to be cleaned that rotates.

13. A charging device comprising:

a charging body; and the cleaning body according to claim 1, the cleaning body cleaning the charging body while rotating in contact with the charging body that rotates.

14. An assembly comprising:

a body to be charged;

a charging body that charges the body to be charged; and the cleaning body according to claim 1, the cleaning body cleaning the charging body while rotating in contact with the charging body that rotates, wherein the body to be charged, the charging body, and the cleaning body are integrally assembled to be attachable and detachable in an apparatus body.

15. An image forming apparatus comprising:

a photosensitive member;

a charging body that charges the photosensitive member;

an exposure device that exposes the charged photosensitive member and forms an electrostatic image;

a developing device that develops the electrostatic image formed on the photosensitive member; and the cleaning body according to claim 1, the cleaning body cleaning the charging body while rotating in contact with the charging body that rotates.

* * * * *